US006406379B1

(12) United States Patent
Christensen

(10) Patent No.: US 6,406,379 B1
(45) Date of Patent: Jun. 18, 2002

(54) FULL-FACE ADAPTER GOLF PUTTER

(75) Inventor: Brent Christensen, Redmond, WA (US)

(73) Assignee: Pacific Tool, Inc., Redmond, WA (US)

( * ) Notice: Subject to any disclaimer, the term of this patent is extended or adjusted under 35 U.S.C. 154(b) by 0 days.

(21) Appl. No.: 09/507,560

(22) Filed: Feb. 18, 2000

Related U.S. Application Data

(60) Provisional application No. 60/120,998, filed on Feb. 19, 1999.

(51) Int. Cl.[7] ..... A63B 53/04; A63B 53/06

(52) U.S. Cl. ..... 473/251; 473/332; 473/340; 473/342

(58) Field of Search ..... 473/313, 314, 473/340, 341, 329, 332, 342, 325, 350, 349, 251, 252, 253, 254, 236, 238, 288; D21/736, 738, 742, 743, 744

(56) References Cited

U.S. PATENT DOCUMENTS 3,042,405 A * 7/1962 Solheim
3,211,455 A * 10/1965 Hyden
3,220,733 A * 11/1965 Saleeby
4,121,832 A * 10/1978 Ebbing
4,156,526 A * 5/1979 Huggins
4,422,638 A * 12/1983 Tucker
4,618,149 A 10/1986 Maxel
4,679,792 A * 7/1987 Straza
4,884,808 A 12/1989 Retzer
5,083,778 A * 1/1992 Douglass
5,332,214 A * 7/1994 Tucker
5,458,332 A * 10/1995 Fisher
5,464,212 A * 11/1995 Cook
5,485,997 A 1/1996 Schmidt et al.
D368,126 S 3/1996 Magerman et al.
5,620,381 A * 4/1997 Spalding
5,643,100 A * 7/1997 Zabytko
5,674,132 A * 10/1997 Fisher
5,718,644 A 2/1998 Donofrio
D392,009 S * 3/1998 Maltby
D410,718 S * 6/1999 Christensen
D415,229 S * 10/1999 Christensen
6,264,571 B1 * 7/2001 Lekavich

* cited by examiner

*Primary Examiner*—Sebastiano Passaniti
(74) *Attorney, Agent, or Firm*—Dean A. Craine

(57) ABSTRACT

A golf club putter including a putter head with a curved bottom surface, a front face with a full-face cavity, an adapter molded into the full-face cavity, and a back surface with a weight-reducing cavity formed therein. The volumes of the full-face and weight reducing cavities are substantially equal to keep the putter head relatively balanced. The adapter is made of a polyurethane material with a hardness of at least Shore A 90 durometer. The inside surface of the adapter is mechanically or adhesively bonded to the inside surface of the full-face cavity thereby enabling the entire energy of impact when a ball is struck to be transmitted throughout the putter head, thereby providing a softer felling to the user. The front and back cavities reduce the mass along the central, transverse axis of the putter head, thereby decreasing the torque about the shaft, which enables the user to more easily maintain the front face in a perpendicularly aligned position during the swing.

4 Claims, 1 Drawing Sheet

FULL-FACE ADAPTER GOLF PUTTER

This is a utility patent application based on the provisional patent application (Serial No. 60/120,998) filed on Feb. 19, 1999.

BACKGROUND OF THE INVENTION

1. Field of the Invention

This invention relates to golf clubs, and more particularly, golf club putters.

2. Description of the Related Art

It is widely known that the front face of the golf putter should be perpendicularly aligned to the path of the putter when the front face of the putter strikes the golf ball. It is also widely known that the face of the putter, rather than the edge of the putter head, should make direct contact with the ball. It is further known that golf putters have a certain "feeling" which determines their popularity. Factors which may influence a putter's "feeling" include the club size, weight, balance, and the shape and orientation of the front face and the shaft.

What is needed is a golf putter which enables a user to keep the front face perpendicular to the path of the swing, that has a full-face front surface, and has a unique "feeling" when used.

SUMMARY OF THE INVENTION

It is an object of the present invention to provide an improved golf putter.

It is another object of the present invention to provide a golf putter with balanced heel and toe sections that enables the user to keep the front face perpendicular to the path of the swing.

It is a further object of the present invention to provide such a golf putter that uses a putter head that can be easily adapted for manufacturing golf putters for both right and left-handed golfers.

These and other objectives are met by a golf club putter including a putter head with a curved bottom surface, a front edge surface surrounding a full-face front cavity, an adapter disposed inside into the front cavity that covers substantially all of the front face of the putter, and a back surface with a weight reducing back cavity formed therein. The front edge face and back surface of the putter head are parallel and symmetrical about the vertical mid-line axis of the putter head. The adapter has a flat, diagonally aligned, front surface perpendicularly aligned neck section that is disposed inside the front cavity. In the preferred embodiment, the adapter is made of synthetic, lightweight material with a hardness of at least Shore A 90 durometer. The front surface of the adapter has a loft angle of approximately 4 degrees. The inside surface of the neck section adapter is mechanically or adhesively bonded to the inside surface of the front cavity. During use, the energy used to strike the ball is transmitted through the adapter and putter head thereby providing a softer feeling for the user.

While the size and shape of the front and back cavities reduce the overall mass and weight of the putter, they are also shaped and positioned to create opposite toe sections on the putter. The toe and heel sections are equal in weight, which decrease the torque about the shaft during the swing and at impact thereby enabling the user to more easily maintain the front face of the adapter in a perpendicular aligned position to the path of the swing. By using a symmetrically designed, equal weighted heel and toe sections, a full-face adapter, and a center located shaft, the putter head can be easily manufactured for right and left-handed golfers.

DESCRIPTION OF THE PREFERRED EMBODIMENT(S)

Figure 1:
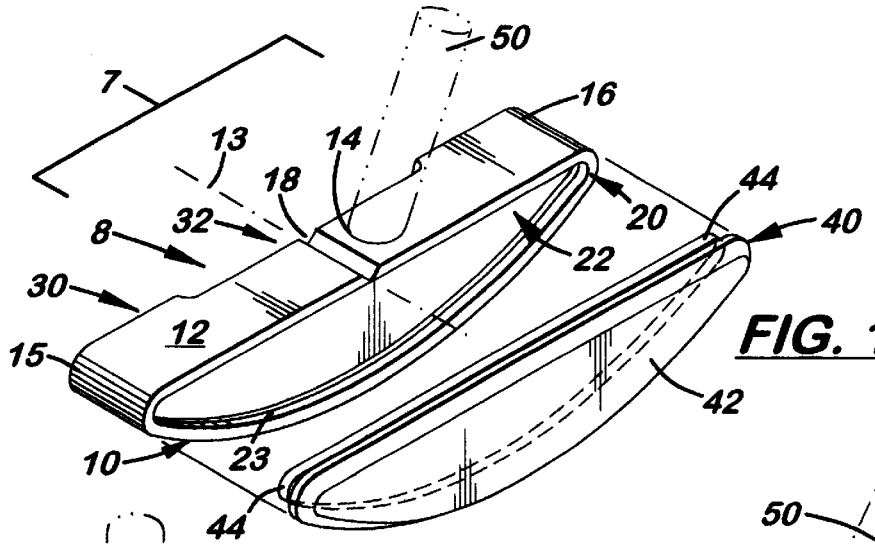
FIG. 1 is a perspective view of the improved golf putter, showing the adapter being inserted into the full-face cavity.
Figure 2:
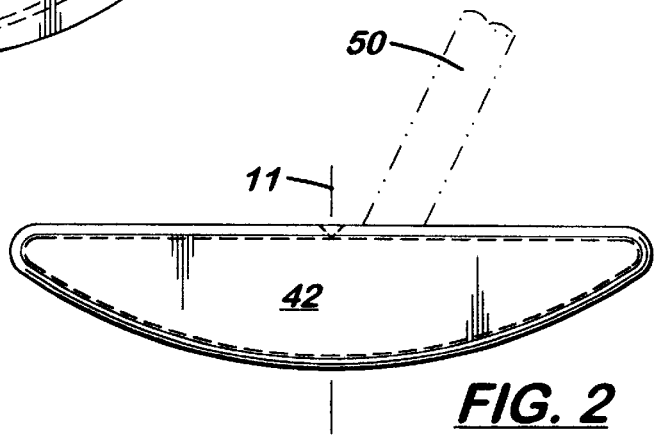
FIG. 2 is a front elevational view of the golf putter.
Figure 6:
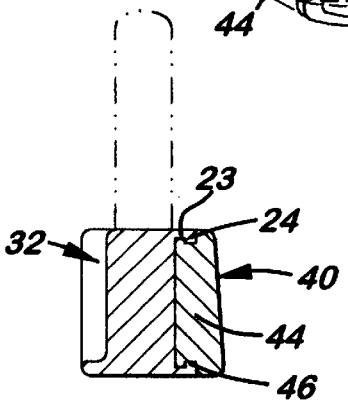
FIG. 6 is a sectional, end elevational view taken along line 6—6 in FIG. 5.
Figure 3:
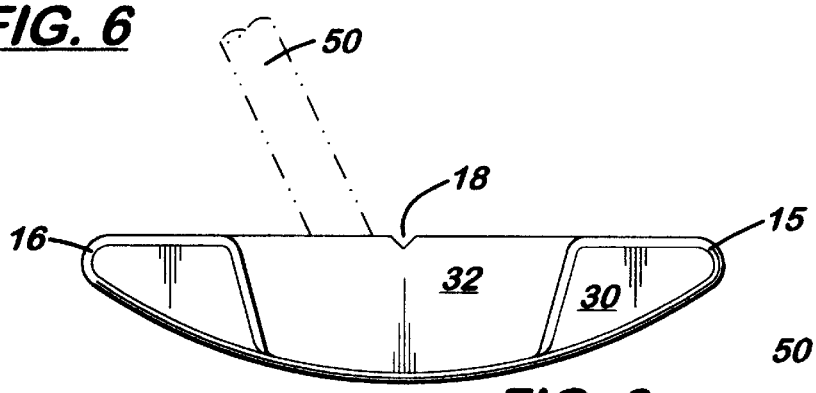
FIG. 3 is a rear elevational view of the golf putter.
Figure 4:
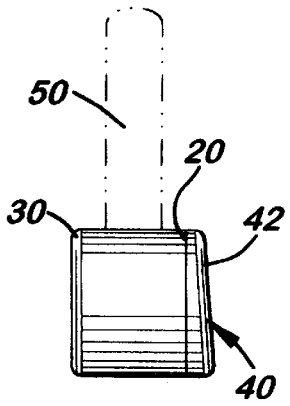
FIG. 4 is an end elevational view of the golf putter.
Figure 5:
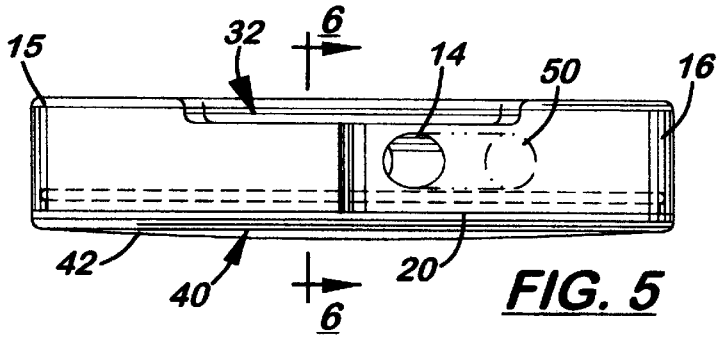
FIG. 5 is a top plan view of the golf putter.

These and other objectives are met by a golf club putter 7 including a putter head 8 with a shaft 50 attached thereto. The putter head 8 is symmetrically designed about its central midline axis 11 and includes a curved bottom surface 10, a flat top surface 12, a front edge face 20 with a full-face cavity 22, and a back surface 30 with a weight-reducing cavity 32 formed therein. The shape and size of the front and back cavities 22, 32, respectively, are sufficient so that the top and heel sections 15, 16, respectively, of the putter head 8 are equal in weight and balanced on opposite sides of the mid-line vertical axis 11. By making the toe and head sections 15, 16 equal in distance from the central mid-line axis 11 and in weight, the putter head's 8 torque about the shaft 50 is decreased during the swing and at the point of impact, which enables the user to more easily maintain the putter head 8 in a perpendicular aligned position.

Attached to the front cavity 22 is an adapter 40 designed to completely cover the front edge face 20 of the putter head 8. The adapter 40 is made of a synthetic material, such as polyurethane, with a hardness of at least Shore A 90 durometer. The adapter 40 is complimentary in shape to the front edge face 20 and includes a perpendicularly aligned neck section 44 that during assembly, is disposed against the inside surfaces of the side walls 23 of the front cavity 22. The inside surface of the adapter 40 includes slots 46 which mechanically engage the inward directed lips 24 formed on the surface inside the front cavity 22. An optional adhesive is used to further bond the adapter 40 to the inside surface of the front cavity 22 thereby enabling the entire energy of impact when a ball is struck to be transmitted throughout the putter head 8, thereby providing a softer feeling to the user. In the preferred embodiment, the adapter 40 is molded directly into the front cavity 22.

Formed on the top surface 12 of the putter head 8 is a transversely aligned, V-shaped alignment groove 18. The groove 18 is aligned with the mid-line transverse axis 13 and the mid-line vertical axis 11. A suitable paint may be applied to the groove 18 to improve its visibility.

In the preferred embodiment, the putter head 8 is made of brass or other suitable material. It measures approximately 4.5 inches in length, 1.125 inches in width (including the adapter 40) and 1.0 inch thick at the mid-line vertical axis 11. The curved bottom surface 10 is an arc with a 3.75 inch radius. The toe and heel sections 15, 16, respectively, are each approximately 1.0 inch in width and their distal edges are equally curved. The bore 14 is aligned 22.5 degrees above the top surface 12 of the putter head 8. The bore 14 is approximately 0.372 of an inch in diameter and 0.75 of an inch in depth. The shaft 50 is 0.370 of an inch in diameter.

A suitable adhesive may be used to permanently attach the shaft 50 inside the bore 14. The bore 14 is positioned so that the tip of the shaft 50 if extended downward to intersect with the curved bottom surface 10, would be centered over the mid-line vertical axis 11 of the putter head 8. In the preferred embodiment, a power coat is applied over the entire putter head 8 to provide a protective coating thereto. The adapter 40 is complimentary in shape to the front edge face 20 and extends forward therefrom approximately 0.125 of an inch.

In compliance with the statute, the invention has been described herein in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A golf putter head comprising:

a. a symmetrically curved bottom surface, a top flat surface, and a parallel front edge face and a back surface;

b. a full-face front cavity formed on said front surface and surrounded by said front edge face;

c. full-face adapter inserted into said front cavity and covering said front edge face, said adapter made of synthetic material having a hardness of at least Shore A 90 durometer;

d. a back cavity formed on said back surface, said back cavity being complementary in shape and size with said front cavity to create equal weight toe and heel sections, and;

e. a bore formed on said head used to receive a golf club shaft, said bore being diagonally aligned to intersect the vertical mid-line axis of said head if extended through said bottom surface.

2. A golf putter head, as recited in claim 1, further including an aiming marking located on said top surface.

3. A golf putter head, as recited in claim 1, wherein said adapter has a front surface aligned at a 4 degree loft when inserted into said front cavity.

4. A golf putter head, as recited in claim 1, wherein said adapter is molded inside said front cavity.

* * * * *